US011229238B2

(12) United States Patent
Ding

(10) Patent No.: US 11,229,238 B2
(45) Date of Patent: Jan. 25, 2022

(54) TOBACCO EVAPORATOR AND HEATING CONTROL METHOD

(71) Applicant: SHENZHEN JIANAN TECHNOLOGY CO., LIMITED, Guangdong (CN)

(72) Inventor: Jianjun Ding, Guangdong (CN)

(73) Assignee: SHENZHEN JIANAN TECHNOLOGY CO., LIMITED, Shenzhen (CN)

( * ) Notice: Subject to any disclaimer, the term of this patent is extended or adjusted under 35 U.S.C. 154(b) by 516 days.

(21) Appl. No.: 16/093,965

(22) PCT Filed: Apr. 28, 2017

(86) PCT No.: PCT/CN2017/082385
§ 371 (c)(1),
(2) Date: Oct. 15, 2018

(87) PCT Pub. No.: WO2018/195902
PCT Pub. Date: Nov. 1, 2018

(65) Prior Publication Data

US 2020/0345070 A1 Nov. 5, 2020

(51) Int. Cl.
*A24F 40/46* (2020.01)
*A24F 40/57* (2020.01)
(Continued)

(52) U.S. Cl.
CPC ..... *A24F 40/46* (2020.01); *A24D 3/17* (2020.01); *A24F 7/02* (2013.01); *A24F 40/51* (2020.01);
(Continued)

(58) Field of Classification Search
CPC ..... A24F 40/46; A24F 40/465; A24F 40/50; A24F 47/008; A24F 47/002; A24F 40/57;
(Continued)

(56) References Cited

U.S. PATENT DOCUMENTS 5,750,964 A * 5/1998 Counts ..... A24F 40/46 219/535
2013/0298905 A1* 11/2013 Levin ..... A24F 40/00 128/202.21
2015/0245669 A1* 9/2015 Cadieux ..... A24F 40/50 131/329

FOREIGN PATENT DOCUMENTS

CN 205547352 U 9/2016
CN 205547353 U 9/2016

* cited by examiner

*Primary Examiner* — Michael H. Wilson
*Assistant Examiner* — Stephanie Lynn Moore

(57) ABSTRACT

The present application refers to a tobacco evaporator and a heating control method comprising a housing and a suction nozzle connected to the housing; a first chamber and a second chamber which are defined inside the housing, a heating element is defined in the second chamber; a mesh filter layer structure is defined between the first chamber and the heating element to position a substance to be evaporated, and uniformly heat the substance to be evaporated when the heating element generates heat; a thermal insulation structure is defined outside the second chamber to thermally insulate the second chamber while the heating element generates heat. The present application realizes technical effects that the tobacco evaporator has short preheating time, small battery energy consumption, and can bake softly tasted and uniformly baked smoke.

11 Claims, 6 Drawing Sheets

(51) Int. Cl.

| | |
|---|---|
| ***A24F 40/51*** | (2020.01) |
| ***A24D 3/17*** | (2020.01) |
| ***A24F 7/02*** | (2006.01) |
| *A24F 40/485* | (2020.01) |
| *A24F 40/20* | (2020.01) |

(52) U.S. Cl.
CPC ..... *A24F 40/57* (2020.01); *A24F 40/20* (2020.01); *A24F 40/485* (2020.01)

(58) Field of Classification Search
CPC ..... A24F 40/20; A24F 40/485; A24F 40/40; A24F 40/51; A24F 40/00; A24F 40/10; A24F 40/42; A24F 40/60; A24F 40/90; A24F 7/02; H05B 1/0244; H05B 2203/021; H05B 3/16
See application file for complete search history.

TOBACCO EVAPORATOR AND HEATING CONTROL METHOD

FIELD OF THE PRESENT APPLICATION

The present application relates to a field of electronic cigarette devices, and more particularly relates to a tobacco evaporator and a heating control method.

BACKGROUND OF THE PRESENT APPLICATION

At present, there are three methods for a tobacco evaporator to heat substances to be evaporated (such as tobacco, cigarettes, etc.): The first method is that the tobacco pot is made of a thermal conductive material, and a metal heating plate is wrapped around an outer wall of the tobacco pot and transfers heat to the tobacco in the tobacco pot through thermal conduction, so as to achieve the purpose of evaporating an active ingredient of the tobacco; The second method is that the tobacco pot is made of a ceramic material, and a conductive film is printed on an inner portion or an inner wall of a ceramic pot, and the heat generated after energization is conducted to the tobacco through the ceramic pot; The third method belongs to an air heating technology, which uses hot air to heat the tobacco, and the airflow will uniformly pass the tobacco in the whole tobacco pot.

Among them, the second method is superior to an externally wrapped electric-thermal film method (i.e., the first method) in that the tobacco pot is generally made of aluminum or stainless steel to ensure the thermal conduction efficiency in the externally wrapped electric-thermal film method, but at the same time, because the metal has conductivity, hence it is generally necessary to wrap a layer of a high temperature resistant insulation material on the metal pot before wrapping the electric-thermal film. Therefore, in this method, although the insulation is realized, the heat conduction efficiency is also weakened; the first method also has the problem of affecting the consistency of a heating rate of the product, due to the difference in tightness of the electric-thermal film. However, the first method and the second method are both directly thermal conduction methods, baked tobacco has a problem of uneven heating, and the taste of baked smoke is irritating. Baked smoke of the third method has a soft taste and the tobacco is uniform baked, which is enough to overcome the above defects. However, the products of the air heating technology have disadvantages of too long preheating time and too much energy loss.

That is to say, the existing tobacco evaporator cannot solve the technical problem of short preheating time and low energy consumption while softly tasted and uniformly baked smoke.

SUMMARY OF THE PRESENT APPLICATION

One embodiment of the present application provides a tobacco evaporator comprising a first chamber configured to accommodate a substance to be evaporated, and a second chamber configured to define a heating element, the first chamber and the second chamber are communicated with each other to form a first airflow passage;

At least two spaced layers of mesh filter layer structures are defined in one end of the first chamber adjacent to the second chamber, the filter layer structures comprising a first filter layer, and a second filter layer which is defined between the first filter layer and the second chamber, the first filter layer is distributed with a plurality of first filter holes, the second filter layer is provided with a plurality of second filter holes;

The heating element extends along an axial direction of the second chamber in a spiral shape and abuts against a chamber wall of the second chamber to transfer heat to the substance to be evaporated through the first airflow passage when the heating element generates heat, so as to uniformly heat the substance to be evaporated; and the second chamber is provided with a heat insulation sleeve to thermally insulate the second chamber when the heating element generates heat.

Typically, the tobacco evaporator further comprises a housing comprising a receiving space, and a suction nozzle connected to the housing, the suction nozzle has a smoke outlet, a barrel body extending axially along the housing is detachably defined inside the receiving space;

The barrel body comprises a first barrel body and a second barrel body which is formed by radially shrinking along the first barrel body, and the first chamber is formed in the first barrel body, the second chamber is formed in the second barrel body; and One end of the heat insulation sleeve abuts against an end wall of the first barrel body opposite to the suction nozzle, and the other end of the heat insulation sleeve is connected and provided with a supporting assembly, the supporting assembly is configured to fixedly define the barrel body inside the housing.

Typically, a bottom portion of the second barrel body is provided with a through hole, and a holding member is sleeved inside the through hole, one end of the holding member near the suction nozzle is abutted against a bottom wall of the second barrel body, and the holding member is hollow and provided with a second air inlet hole; and An end wall of the first barrel body opposite to the suction nozzle is further provided with a first connecting hole.

Typically, a hollow bracket is defined inside the housing; the barrel body, the heat insulation sleeve and the supporting assembly are all accommodated inside the bracket;

One end of the bracket near the suction nozzle is provided with a bending portion, the bending portion comprises a limiting portion, and the limiting portion is elastically abutted against an end wall of the barrel body near the suction nozzle, so as to define a space distance between an outer wall of the barrel body and an inner wall of the bracket;

An outer wall of one end of the bracket near the suction nozzle is further provided with a convex portion, the convex portion is configured to define a space distance between an outer wall of the bracket and an inter wall of the housing; and A sealing cover is defined at one end of the bracket opposite to the suction nozzle, and the bracket is partially sleeved and fitted on an outer periphery of the sealing cover and is detachably connected to the sealing cover.

Typically, the supporting assembly comprises a hollow pipe defined opposite to the suction nozzle and a support sleeve defined adjacent to the suction nozzle, the heat insulation sleeve is partially sleeved and fitted on an outer circumference of the support sleeve, and the support sleeve is provided with two second connection holes which are opposite to each other;

The sealing cover is provided with a first air inlet hole, and an end of the hollow pipe opposite to the suction nozzle abuts against the sealing cover; the first air inlet hole, the hollow pipe and the second air inlet hole are sequentially in communications and communicate with the first air passage for directing smoke to the smoke outlet; and An air guiding passage is defined at one end of the housing opposite to the suction nozzle, and the air guiding passage is communicated with the first air inlet hole through a hollow intake pipe, and an airflow sensing hole are defined in a side wall of the air guiding passage.

Typically, a first space for heat insulating is defined between the first barrel body and the bracket, the first space is filled with a thermal insulation material;

A second space for insulating is defined between the heat insulation sleeve and the second barrel body; and A third spacing space is further defined between the housing and the bracket.

Typically, the tobacco evaporator further comprises:

A temperature sensor defined on an outer wall of the first barrel body to measure a temperature of the first chamber and transmit a temperature signal;

A PCB circuit board defined in the third spacing space;

An airflow sensor defined in a groove provided in an outer wall of the air guiding passage, and communicated with the air guiding passage through the airflow sensing hole to sense and transmit an airflow signal;

A controller defined on the circuit board and connected to the heating element, the temperature sensor and the airflow sensor, respectively, to receive the airflow signal and the temperature signal, and control the heating element to heat the substance to be evaporated according to a predetermined temperature;

A battery defined in the third spacing space to supply power to the airflow sensor, the temperature sensor, the controller and the heating element; and A switch defined on an outer wall of the housing and respectively connected to the controller and the battery to control a connection of the controller and the battery.

Typically, one end of the heating element passes through the holding member and goes through one of the second connecting holes to extend toward the sealing cover and pass through the sealing cover to connect to the controller around one side of the battery, the other end of the heating element passes through the first connecting hole and goes through the other one of the second connecting holes to pass through the sealing cover to connect to the controller around another side of the battery, two ends of the heating element are separately and respectively soldered on opposite sides of the PCB circuit board.

Typically, an inner wall of one end of the first barrel body opposite to the suction nozzle radially shrinks inward to form a first limiting step and a second a limiting step, the first limiting step and the second limiting step are respectively configured to clamp and position the first filter layer and the second filter layer, so as to provide a flow gap between the first filter layer and the second filter layer to flow hot air, the flow gap between the first filter layer and the second filter layer ranges from 0.5 mm to 8 mm.

Typically, a diameter of each of the first filter holes ranges from 0.2 to 3.0 mm, and the plurality of the first filter holes uniformly distributed in the first filter layer, a distance between centers of each two adjacent first filter holes ranges from 0.6 mm to 3.0 mm; and A diameter of each of the second filter holes ranges from 0.8 to 6 mm, and a distance from a center of each of the second filter holes to a center of the second filter layer ranges from 2 mm to 12 mm.

Typically, a mesh smoke filtering layer is further defined between the first chamber and the suction nozzle, and the smoke filtering layer is configured to filter smoke flowing from the first chamber to the suction nozzle and to prevent the substance to be evaporated from coming off the first chamber.

Typically, the barrel body is made of a metal material or a ceramic material, the heat insulation sleeve, the supporting assembly, the bracket and the sealing cover are all made of a thermal insulation material.

The present application further provides a heating control method using the tobacco evaporator, comprising following steps:

S1. placing the substance to be evaporated on the first filter layer in the first chamber;

S2. controlling the heating element to heat cold air entering the first chamber and heating the substance to be evaporated according to the predetermined temperature.

Typically, the step S2 comprises following steps:

S21. when the airflow sensor detects the airflow signal and transmits to the controller, or when the controller is manually controlled to operate by a user, the controller controls the heating element to heat to a first predetermined temperature;

S22. the airflow sensor continues detecting the airflow signal, proceeds to step S23; the airflow sensor does not detect the airflow signal again, proceeds to step S24;

S23. the controller controls the heating element to heat to a second predetermined temperature, the temperature sensor measures the temperature of the first chamber and transmits the temperature signal to the controller, the controller controls the heating element to continue heating when detected temperature is lower than the second predetermined temperature, and the controller controls the heating element stops heating when the temperature is higher than the second predetermined temperature;

S24. the temperature sensor measures the temperature of the first chamber and transmits the temperature signal to the controller, the controller controls the heating element to continue heating when the detected temperature is lower than the first predetermined temperature, and the controller controls the heating element to stop heating when the temperature is higher than the first predetermined temperature.

One or more technical solutions provided in embodiments of the present application have at least following technical effects or advantages: dispersing heat generated by the heating element by providing mesh filter layer structures, so as to uniformly heat the substance to be evaporated which is placed on the mesh filter layer structures, then scorching will not occur; a heat insulation structure is defined outside the second chamber, when the heating element generates heat, heat dissipation of the second chamber is slowed down, so as to shorten the preheating time of a heating wire and save battery power. The present application effectively solves the technical problem that the tobacco evaporator in the prior art cannot ensure short preheating time and small energy consumption, and cannot achieve softly baking taste and uniform baking smoke.

BRIEF DESCRIPTION OF THE DRAWINGS

In order to more clearly illustrate the embodiments of the present application or the technical solutions in the prior art, the drawings used in the embodiments or the description of the prior art will be briefly described below. Obviously, the drawings in the following description are only embodiments of the present application, and those skilled in the art can obtain other drawings according to the provided drawings without any creative work.

DETAILED DESCRIPTION OF THE PREFERRED EMBODIMENT

The present application solves the technical problem that the tobacco evaporator in the prior art cannot ensure short preheating time and low energy consumption while softly tasted and uniformly baked smoke, by providing a tobacco evaporator to realize technical effects that the tobacco evaporator has the short preheating time, the small battery energy consumption, and can bake softly tasted and uniformly baked smoke.

For well understanding of the above technical solutions, the above technical solutions will be described in detail in conjunction with the drawings and typical embodiments. It should be understood that embodiments and specific features of the embodiments of the present application are detailed descriptions to the technical solutions of the present application, rather than limitations of the technical solutions of the present application. In case of no conflicts, the embodiments and specific features of the embodiments of the present application may be combined with each other.

First Embodiment

Figure 1:
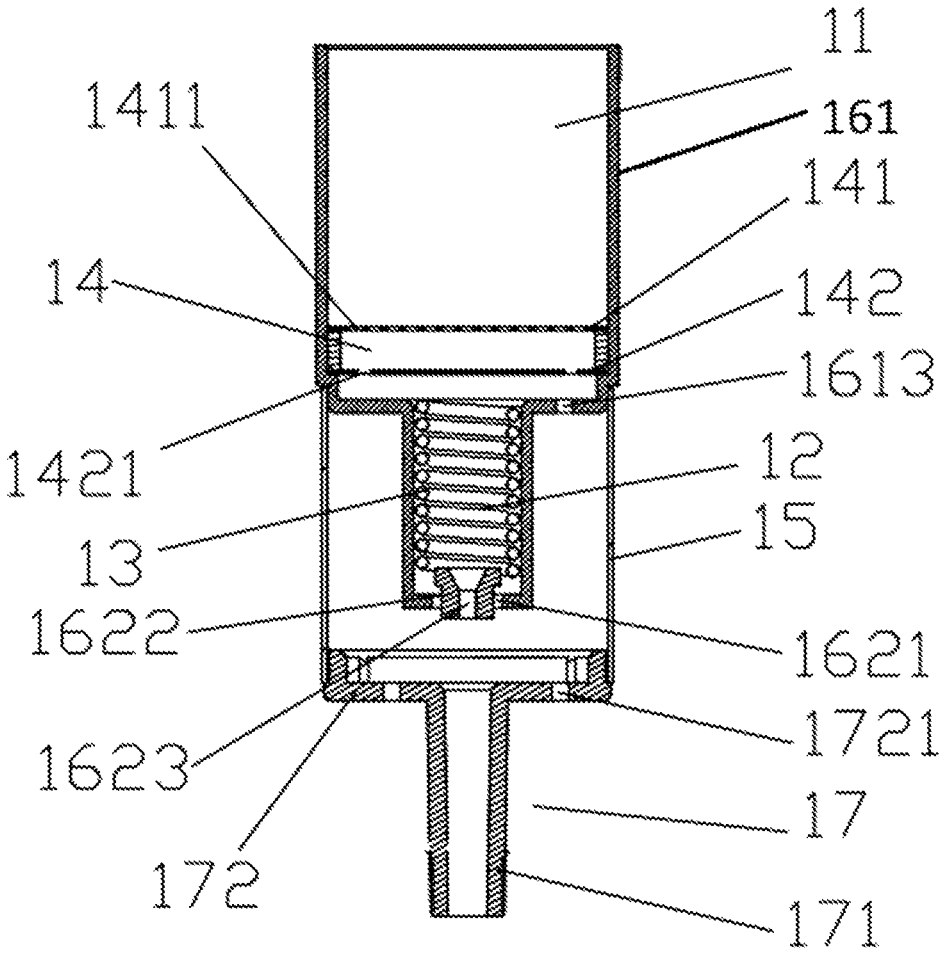
FIG. 1 is a schematic structural view of a tobacco evaporator provided by a first embodiment of the present application.

As shown in FIG. 1, the embodiment of the present application provides a tobacco evaporator comprising a first chamber 11 configured to accommodate a substance to be evaporated, and a second chamber 12 configured to define a heating element 13, the first chamber 11 and the second chamber 12 are communicated with each other to form a first airflow passage; the substance to be evaporated may be cigarette, tobacco, herbs or volatile drugs, etc.

Referring to FIG. 1, at least two spaced layers of mesh filter layer structures 14 are defined in one end of the first chamber 11 adjacent to the second chamber 12, the filter layer structures 14 comprising a first filter layer 141, and a second filter layer 142 which is defined between the first filter layer 141 and the second chamber 12, the first filter layer 141 is distributed with a plurality of first filter holes 1411, and the second filter layer 142 is provided with a plurality of second filter holes 1421; After cold air enters the second chamber 12, the cold air is heated by the heating element 13, diffuses in a gap, flows as an airflow direction to fully contact with mesh filter layer structure 14, and transfers heat to the mesh filter layer structures 14, the mesh filter layer structure 14 is uniformly heated, so that the substance to be evaporated placed on the mesh filter layer structure 14 is uniformly heated, so as to bake softly tasted smoke of the baking outlet is soft.

Typically, the heating element 13 extends along an axial direction of the second chamber 12 in a spiral shape and abuts against a chamber wall of the second chamber 12 to transfer heat to the substance to be evaporated through the first airflow passage when the heating element 13 generates heat, so as to uniformly heat the substance to be evaporated; the second chamber 12 is provided with a heat insulation sleeve 15 to thermally insulate the second chamber 12 when the heating element 13 generates heat, so as to slow heat in the second chamber 12 to be transferred to the surroundings, and to shorten the preheating time of the heating wire and save the battery power.

Figure 2:
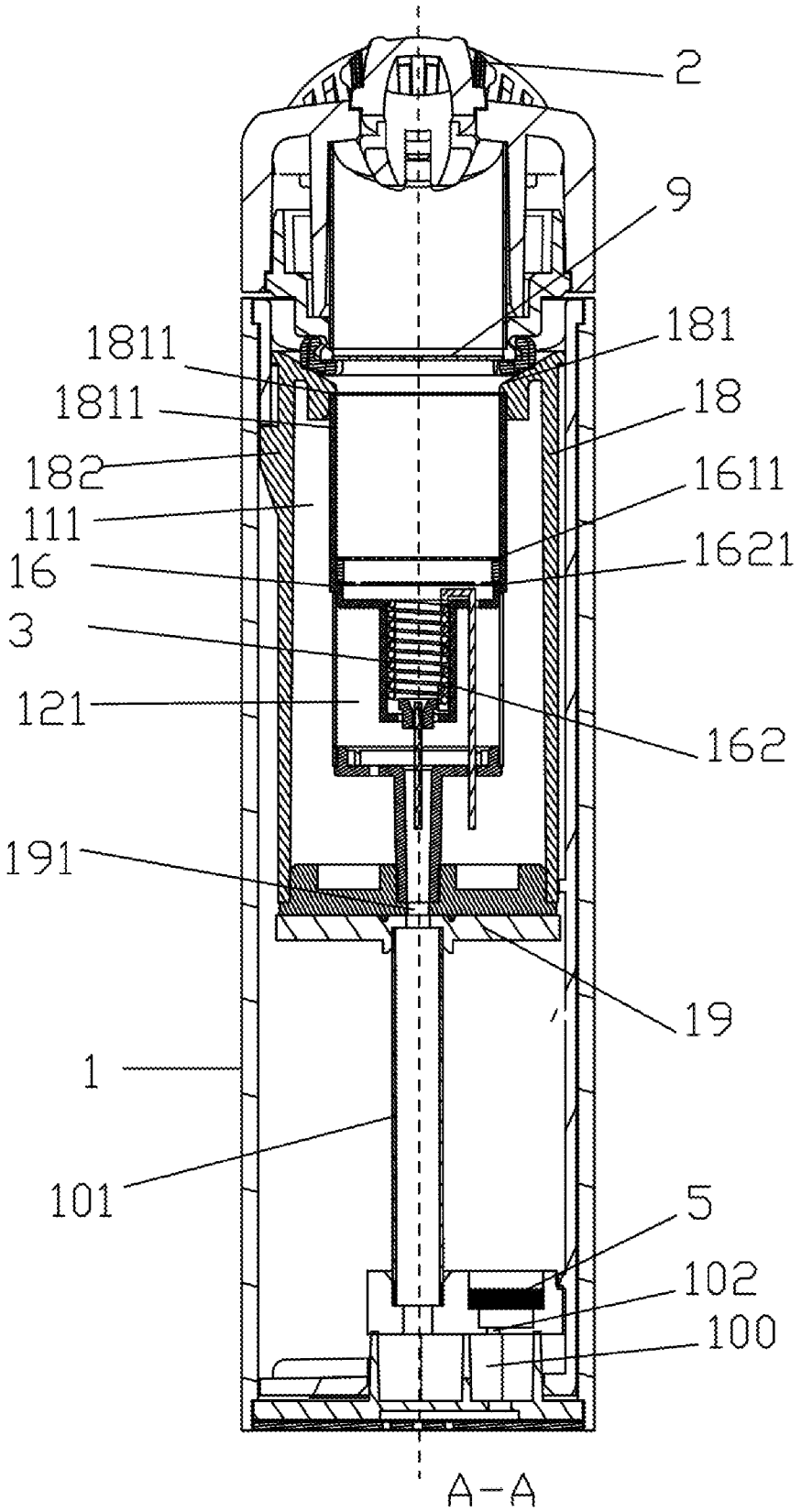
FIG. 2 is a cross-sectional view of the tobacco evaporator in the A-A direction according to the first embodiment of the present application.
Figure 3:
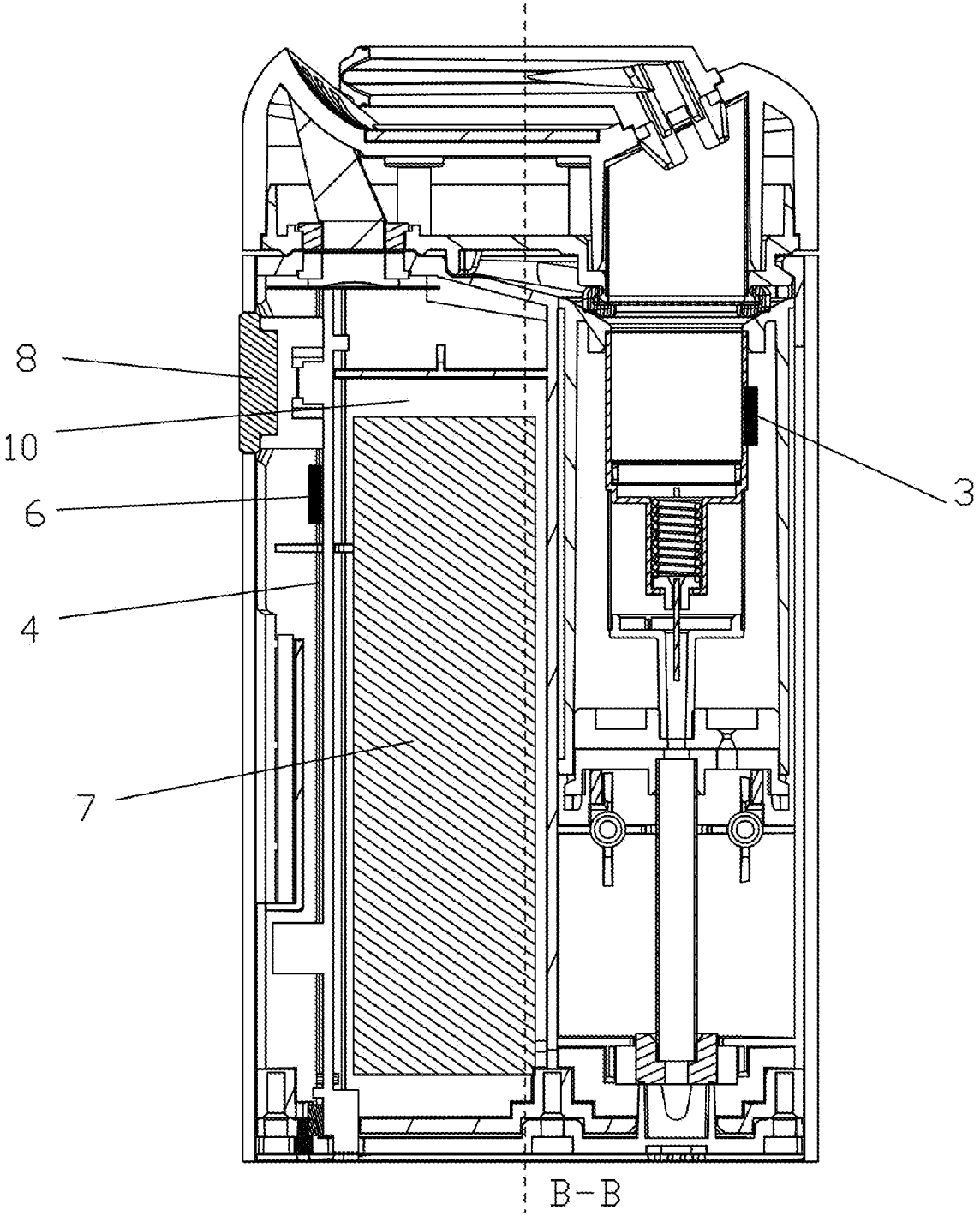
FIG. 3 is a cross-sectional view of the tobacco evaporator in the B-B direction according to the first embodiment of the present application.

Combined with FIGS. 1-3, the tobacco evaporator further comprises a housing 1 comprising a receiving space, and a suction nozzle 2 connected to the housing 1. The housing 1 is a substantially elliptical cylindrical structure, the suction nozzle 2 has a smoke outlet, a barrel body 16 extending axially along the housing 1 is detachably defined inside the receiving space. The barrel body 16 is made of a metal material or a ceramic material, and is an integrally formed structure, the barrel body 16 comprises a first barrel body 161 and a second barrel body 162 which is formed by radially shrinking along the first barrel body 161, and the first chamber 11 is formed in the first barrel body 161, the second chamber 12 is formed in the second barrel body 162; one end of the heat insulation sleeve 15 abuts against an end wall of the first barrel body 161 opposite to the suction nozzle 2, and the other end of the heat insulation sleeve 15 is connected and provided with a supporting assembly 17, the supporting assembly 17 is configured to fixedly define the barrel body 16 inside the housing 1, and to reduce heat loss. Since a high temperature is required to be tolerated, the supporting assembly 17 is typically made of a ceramic material with a loose internal structure.

A bottom portion of the second barrel body 162 is provided with a through hole 1621, and a holding member 1622 is sleeved inside the through hole 1621, the holding member 1622 has a hollow trumpet shape, and comprises a straight barrel portion and a connecting portion that extends outward along the straight barrel portion. An outer circumference of the connecting portion of the holding portion 1622 is abutted against a bottom wall of the second barrel body 162, and the holding member 1622 is hollow and provided with a second air inlet hole 1623; an end wall of the first barrel body 161 opposite to the suction nozzle 2 is further provided with a first connecting hole 1613. A wire for connecting one end of the heating wire is provided in and passed through the holding member 1622, and a hole wall between the wire and the second air inlet hole 1623 has an airflow gap configured as an air inlet hole; Certainly, the air inlet hole can be arranged in various methods and other implementations. By one means, one or more air intake through holes may be defined at the bottom of an outer peripheral wall of the holding member 1622, if a solution in a plurality of air intake through holes is to evenly surrounded the air intake through holes, this may ensure uniform flow of airflow and sufficient airflow; Air inlet holes may be defined around the holding member 1622 in a peripheral wall of the second air inlet hole 1623 of the holding member 1622. Certainly, the air inlet holes are not limited to portions described above, and they can be defined at any positions as long as it can ensure that the airflow can be smoothly performed.

In a typical implementation process, in order to ensure that the first filter layer 141 and the second filter layer 142 are separated by a distance, an inner wall of one end of the first barrel body 161 opposite to the suction nozzle 2 radially shrinks inward to form a first limiting step 1611 and a second a limiting step 1612, the first limiting step 1611 and the second limiting step 1612 are respectively configured to clamp and position the first filter layer 141 and the second filter layer 142, so as to provide a flow gap between the first filter layer 141 and the second filter layer 142 to flow hot air, the flow gap between the first filter layer 141 and the second filter layer 142 ranges from 0.5 mm to 8 mm.

Figure 5:
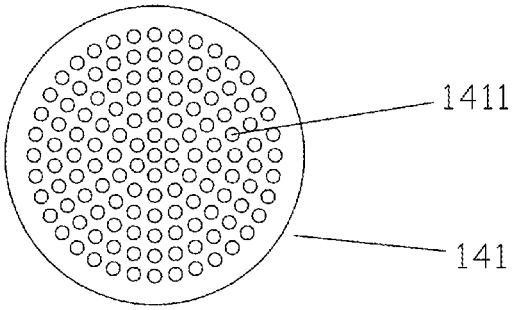
FIG. 5 is a schematic structural view of the first filter in FIG. 1.
Figure 6:
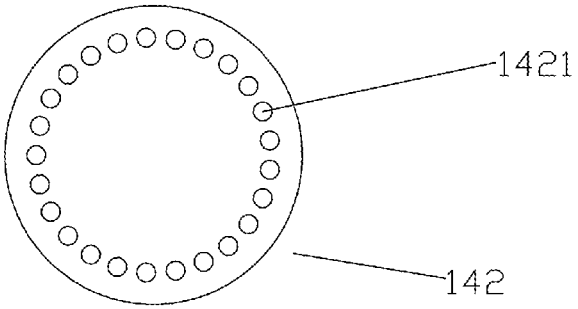
FIG. 6 is a schematic structural view of the second filter of FIG. 1.

As shown in FIG. 5, a diameter of each of the first filter holes 1411 ranges from 0.2 to 3.0 mm, and the plurality of the first filter holes 1411 uniformly distributed in the first filter layer 141, a distance between centers of each two adjacent first filter holes 1411 ranges from 0.6 mm to 3.0 mm; As shown in FIG. 6, a diameter of each of the second filter holes 1421 ranges from 0.8 to 6 mm, and a distance from a center of each of the second filter holes 1421 to a center of the second filter layer 142 ranges from 2 mm to 12 mm; The number of the first filter holes 1411 is larger than the number of the second filter holes 1421. The number of the second filter holes 1421 on the second filter layer 142 opposite to the suction nozzle 2 is larger, the diameter is larger, and the second filter holes 1421 are not defined at the center of the second filter layer 142, and only a portion near a periphery of the second filter layer 142 is provided with the second filter holes 1421, and the second filter holes 1421 form a circle at the portion near the periphery of the second filter layer 142, so that a direction of the airflow can be changed and act as a buffer, while the airflow rate is ensured; the first filter holes 1411 on one end of the first filter layer 141 near the suction nozzle 2 has a smaller diameter and a larger number to ensure the airflow, a evaporation effect is soften, evaporated smoke tasted better, and user experience is improved.

In a specific implementation process, a hollow bracket 18 is defined inside the housing 1; the barrel body 16, the heat insulation sleeve 15 and the supporting assembly 17 are all accommodated inside the bracket 18; one end of the bracket 18 near the suction nozzle 2 is provided with a bending portion 181, the bending portion 181 comprises a limiting portion 1811, and the limiting portion 1811 is elastically abutted against an end wall of the barrel body 16 near the suction nozzle 2, so as to define a space distance between an outer wall of the barrel body 16 and an inner wall of the bracket 18. In this embodiment, the bracket 18 is an elastic heat insulating structure such as a silicone rubber structure or a heat-insulating plastic structure. When the barrel body 16 is not mounted inside the housing 1, an inclination angle of the bending portion 181 is large, and when the barrel body 16 is inserted into the interior of the housing 1 from one end opposite to the suction nozzle 2, the limiting portion 1811 clamps and secures the barrel body 16 to the inside of the casing 1. After the barrel body 16 is installed in the interior of the housing 1, the inclination angle is small, and a setting of the inclination angle plays a certain buffering role in an installation of the barrel body 16, and the barrel body 16 can be clamped inside the housing 1 to ensure a better sealing effect.

In order to further enhance the thermal insulation performance of the tobacco evaporator, a first space 111 for insulating is defined between the first barrel body 161 and the bracket 18, the first space 111 is filled with a thermal insulation material; a second space 121 for insulating is defined between the heat insulation sleeve 15 and the second barrel body 162. The arrangement of the plurality of thermal insulation materials also ensures good thermal insulation and heat preservation effects. A third spacing space 10 is further defined between the housing 1 and the bracket 18, and a control circuit may be defined inside the third spacing space, and the third spacing space 10 and the bracket 18 are thermally insulated so that the control circuit is not affected by temperature of the heating element 13.

As shown in FIG. 2, an outer wall of one end of the bracket 18 near the suction nozzle 2 is further provided with a convex portion 182, the convex portion 182 is configured to define a space distance between an outer wall of the bracket 18 and an inter wall of the housing 1, In this embodiment, the space distance between the outer wall of the bracket 18 and the inner wall of the housing 1 ranges from 1 mm to 5 mm, which saves space of the tobacco evaporator and further enhances the thermal insulation effect. A sealing cover 19 is defined at one end of the bracket 18 opposite to the suction nozzle 2, and the bracket 18 is partially sleeved and fitted on an outer periphery of the sealing cover 19 and is detachably connected to the sealing cover 19.

In a specific implementation process, referring to FIGS. 1 to 4, the supporting assembly 17 comprises a hollow pipe 171 defined opposite to the suction nozzle 2 and a support sleeve 172 defined adjacent to the suction nozzle 2, the heat insulation sleeve 15 is partially sleeved and fitted on an outer circumference of the support sleeve 172, and the support sleeve 172 is provided with two second connection holes 1721 which are opposite to each other; the sealing cover 19 is provided with a first air inlet hole 191, and an end of the hollow pipe 171 opposite to the suction nozzle 2 abuts against the sealing cover 19; the first air inlet hole 191, the hollow pipe 171 and the second air inlet hole 1623 are sequentially in communications and communicate with the first air passage to form a bottom-up entire airflow passage for directing smoke to the smoke outlet. In order to ensure a smooth and adjustable entire airflow passage, in a typical embodiment, each of corresponding air inlet holes is covered with a flexible cover that opens and closes according to the flow of airflow. This flexible cover can be adjusted to different opened degrees depending on the size of the airflow to adjust the size of the airflow.

Figure 4:
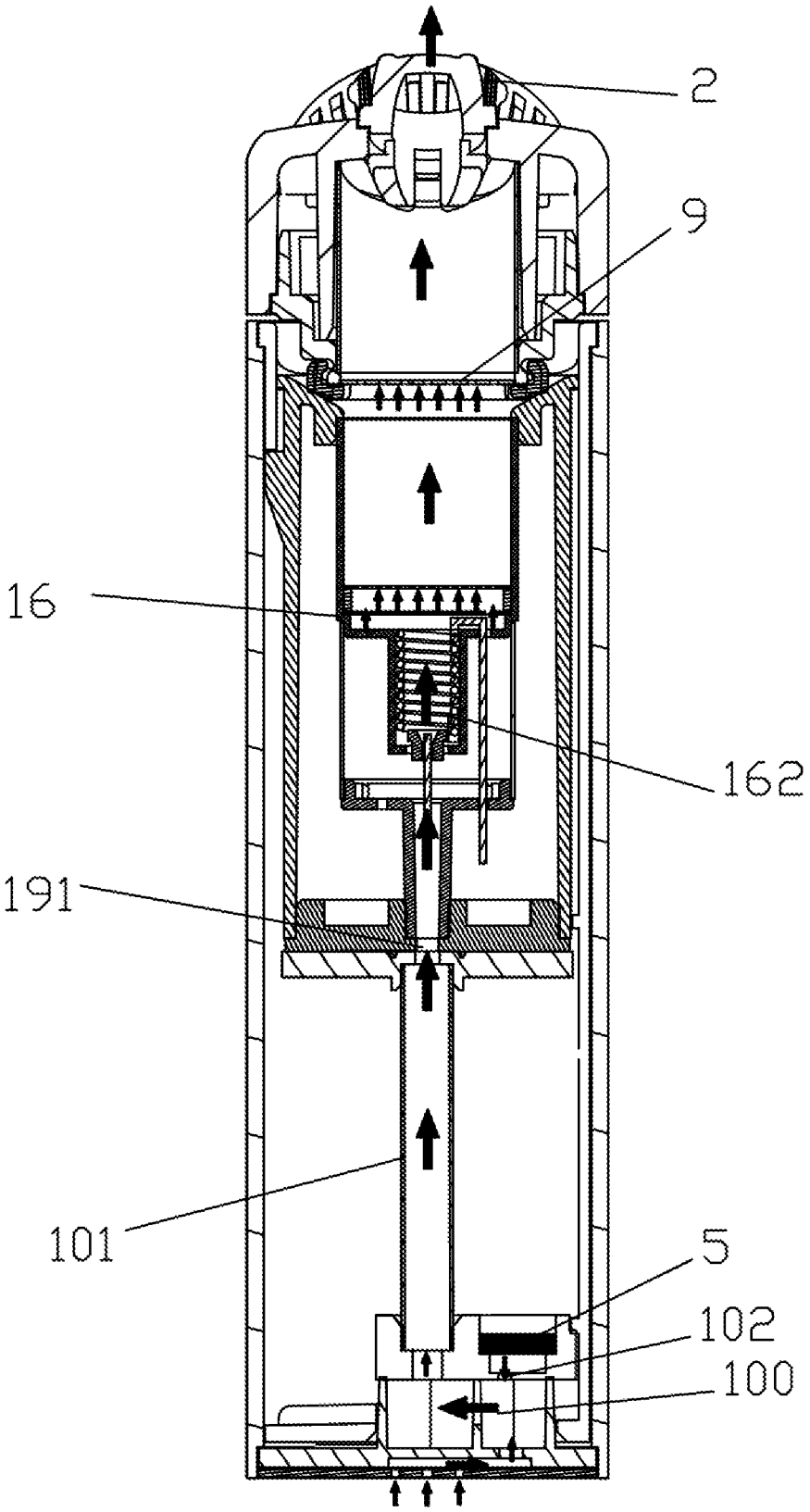
FIG. 4 is a schematic view of a gas flow of a tobacco evaporator provided by a first embodiment of the present application.

Referring to FIGS. 3 to 4, in a specific implementation process, an air guiding passage 100 is defined at one end of the housing 1 opposite to the suction nozzle 2, and the air guiding passage 100 is communicated with the first air inlet hole 191 through a hollow intake pipe 101, and an airflow sensing hole 102 are defined in a side wall of the air guiding passage 100. The airflow enters the intake pipe 101 from the air guiding passage 100, and one end of the intake pipe 101 near the suction nozzle 2 communicates with the first air inlet hole 191, and the air guiding passage 100 is set to be un-straight, so that intake airflow is relatively gentle, so that the size of the airflow is facilitated to be induced, and the airflow to heat the tobacco is buffered to improve the user experience.

The sealing cover 19 is made of a thermal insulation material such as silica gel. A mesh smoke filtering layer 9 is further defined between the first chamber 11 and the suction nozzle 2, and the smoke filtering layer 9 is configured to filter smoke flowing from the first chamber 11 to the suction nozzle 2 and to prevent the substance to be evaporated from coming off the first chamber 11

In order to control the heating element 13 to heat the substance to be evaporated, the tobacco evaporator of this embodiment further comprises: a temperature sensor 3 defined on an outer wall of the first barrel body 16 by means such as pasting or welding, so as to measure a temperature of the first chamber 11 and transmit a temperature signal; A PCB circuit board 4 defined in the third spacing space 10, since the thermal insulation between the third spacing space 10 and the bracket 18, the PCB circuit board 4 can be protected from the high temperature of the heating element 13; An airflow sensor 5 defined in a groove provided in an outer wall of the air guiding passage 100, and communicated with the air guiding passage 100 through the airflow sensing hole 102, when the airflow enters the air guiding passage 100, the flow rate generates a negative pressure, and the air pressure at the airflow sensor 5 is higher than the air pressure in the air guiding passage 100, so that the air at the airflow sensor 5 flows to the air guiding passage 100 through the airflow sensing hole 102. thus, the airflow is sensed, and the airflow generated at the airflow sensor 5 is gentle, which is advantageous for accuracy of the airflow sensor 5 measurement; A controller 6 defined on the circuit board 4 and connected to the heating element 13, the temperature sensor 3 and the airflow sensor 5, respectively, to receive the airflow signal and the temperature signal, and control the heating element 13 to heat the substance to be evaporated according to a predetermined temperature, the controller 6 may adjust the heating temperature by adjusting power of the heating element 13 according to the airflow signal transmitted by the airflow sensor 5 and the temperature signal transmitted by the temperature sensor 3; A battery 7 defined in the third spacing space 10 to supply power to the airflow sensor 5, the temperature sensor 3, the controller 6 and the heating element 13, since the thermal insulation between the third spacing space 10 and the bracket 18, the battery 7 can be protected from the high temperature of the heating element 13; A switch 8 defined on an outer wall of the housing 1 and respectively connected to the controller 6 and the battery 7 to control a connection of the controller 6 and the battery 7, when the switch 8 is pressed, a circuit is turned on, the heating element 13 starts to heat, and the predetermined temperature is predetermined in the controller 6. During an actual heating process, the controller 16 compares an actual received heating temperature with the predetermined temperature, when the actual received heating temperature is greater than the predetermined temperature, a MOS tube is controlled to be disconnected, the switch 8 is connected to the controller 6 through the housing 1 and the bracket 18, and the controller 6 can automatically control a operating state of the heating element 13, and the user can also manually control the operating state of the heating element 13 by the switch 8.

As shown in FIGS. 1 to 3, one end of the heating element 13 passes through the holding member 1622 and goes through one of the second connecting holes 1721 to pass through the sealing cover 19 to connect to the controller 6 around one side of the battery 7, the other end of the heating element 13 passes through the first connecting hole 1613 and goes through the other one of the second connecting holes 1721 to pass through the sealing cover 19 to connect to the controller 6 around another side of the battery 7, two ends of the heating element 13 are separately and respectively soldered on opposite sides of the circuit board 4, so as to avoid short circuit caused by two connecting wires being touched together due to a transportation process or a vibration.

Figure 7:
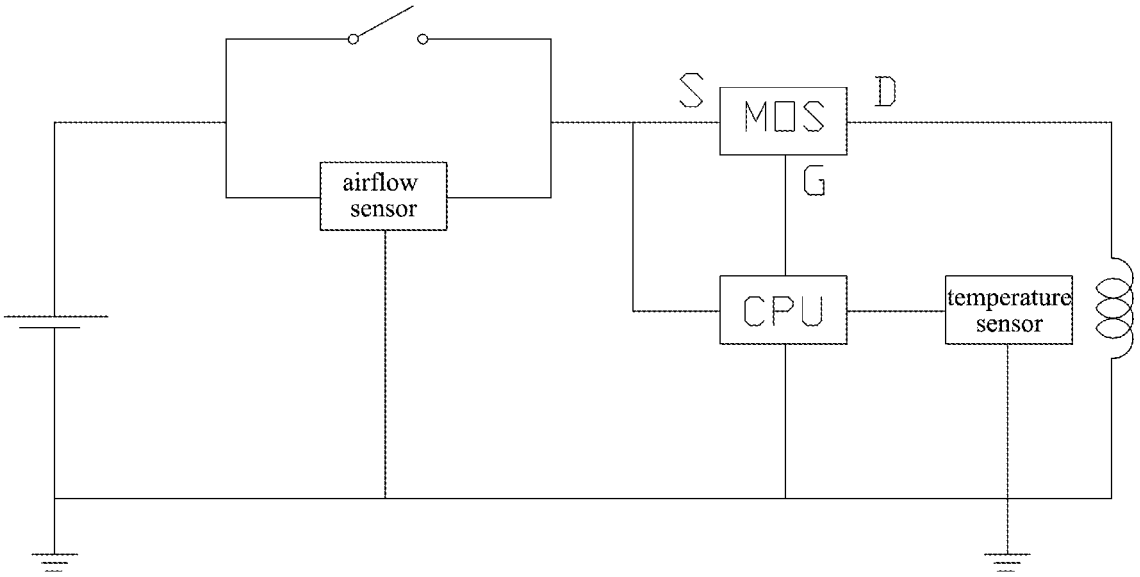
FIG. 7 is a schematic circuit diagram of a tobacco evaporator provided by a first embodiment of the present application.

As shown in FIG. 7, in this embodiment, the controller 6 comprises a microcontroller CPU and a MOS tube. The heating element 13 is a heating wire. The airflow sensor and the switch are connected in parallel and then one end is connected a positive pole of the power supply, and the other end is connected to a source of the MOS tube and the CPU, respectively. A drain of the MOS tube is connected to one end of the heating wire, a gate of the MOS tube is connected to the CPU, the CPU is also connected to one end of the temperature sensor adjacent to the heating wire, the other end of the temperature sensor is grounded, and the other end of the heating wire is connected to a negative pole of the power supply. The negative pole of the power supply is also connected to the airflow sensor and the CPU, respectively. In this circuit diagram, the airflow sensor and the switch are connected in parallel. When the switch is disconnected, the airflow sensor detects the airflow inside the airflow passage caused by a smoking action of the user, and transmits the airflow signal to the CPU, the CPU automatically controls the heating wire to heat, or the user manually controls close the switch, the airflow sensor is shorted, and the CPU controls the heating wire to heat. This design allows the tobacco evaporator to be controlled automatically or manually at the same time. The temperature sensor adjacent to the heating wire transmits a sensed temperature signal to the CPU. When the temperature exceeds the predetermined temperature, such as 200° C., the CPU controls the MOS tube to be turned off to cut off the power supply to stop the heating wire working, and then, the temperature of the heating wire gradually decreases. When the temperature is lower than the predetermined temperature, the CPU controls the MOS tube to be conducted to turn on the power, and the heating wire resumes working. The control of the heating wire by the CPU can ensure short preheating time and low energy consumption, and bake soften tasted and uniformly baked smoke. The switch and the airflow sensor are connected in parallel, so that the circuit is turned on, and the controller controls the opening and closing of the MOS tube to control the operation of the heating element, when it is detected that there is airflow or the switch is closed or both are satisfied. A typical solution: for safety reasons, to prevent occurrence of a false inhalation phenomenon, the circuit can be turned on when the controller receives a switch signal and the airflow signal at the same time, thereby achieving a more reliable control.

Second Embodiment

Figure 8:
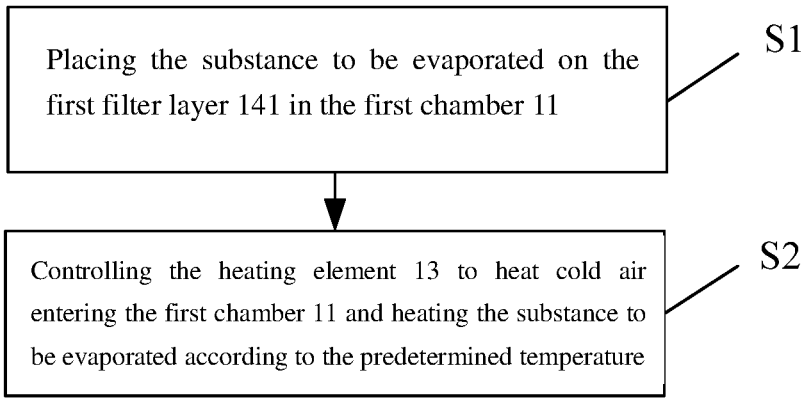
FIG. 8 is a flow chart of a method for evaporating tobacco according to a second embodiment of the present application.

As shown in FIG. 8, the present application further provides a heating control method comprising following steps S1. placing the substance to be evaporated on the first filter layer 141 in the first chamber 11;

Specifically, the tobacco to be evaporated may be placed in the first chamber 1. The tobacco may be in the form of a strip defined in an axial direction, or may be alternately stacked in different directions, so that the flow gap in the middle of the tobacco layer is larger, the heating is more uniform and can effectively shorten the heating time.

S2. controlling the heating element 13 to heat cold air entering the first chamber 11 and heating the substance to be evaporated according to the predetermined temperature.

Third Embodiment

Figure 9:
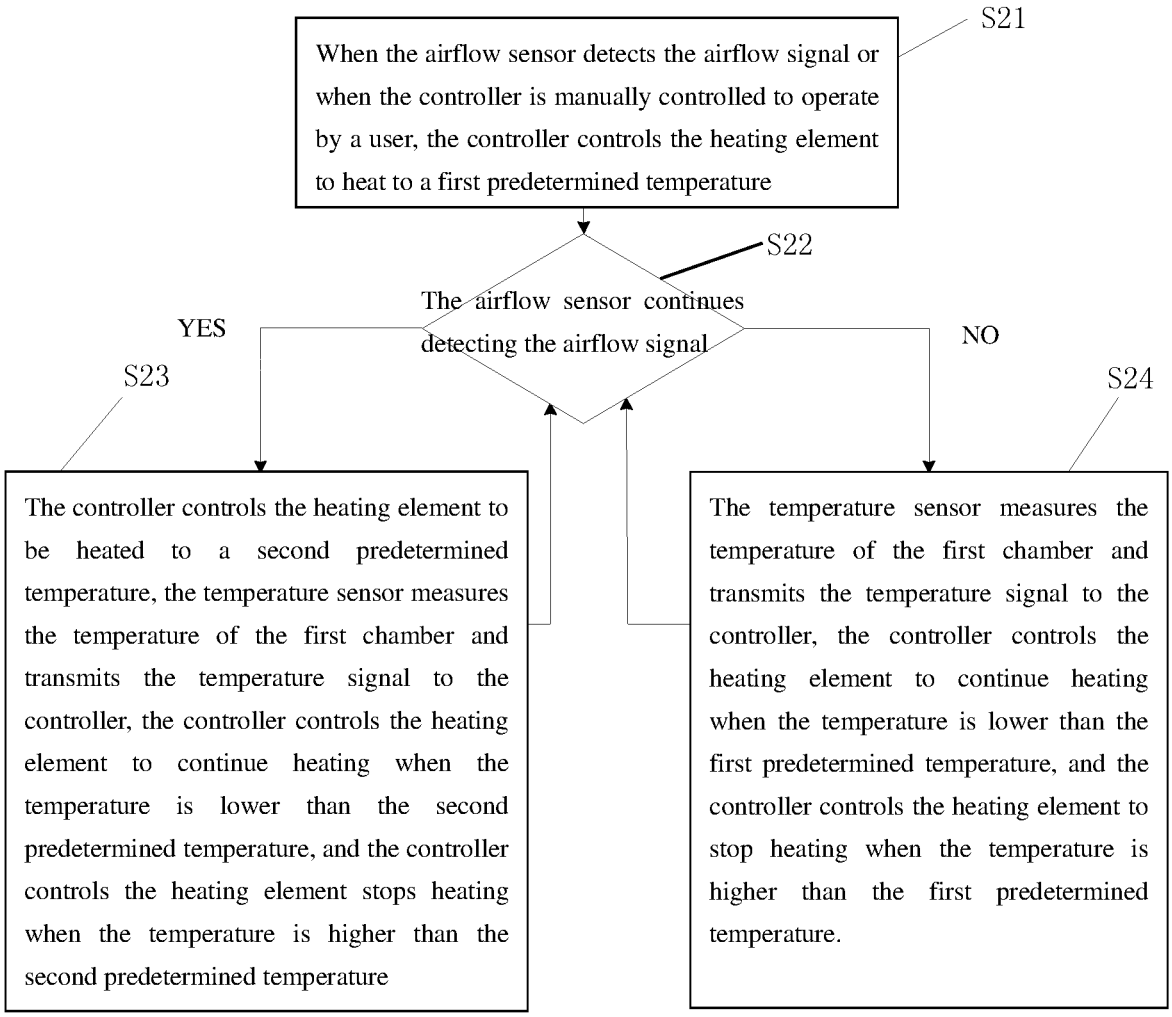
FIG. 9 is a flow chart of a method for evaporating tobacco according to a third embodiment of the present application.

As shown in FIG. 9, the step S2 comprises following steps:

S21, when the airflow sensor 5 detects the airflow signal and transmits to the controller 6, or when the controller 6 is manually controlled to operate by a user, the controller 6 controls the heating element 13 to heat to a first predetermined temperature;

Specifically, the user controls the controller 6 to start operation through the switch 7, and a temperature adjustment button may also be defined at the switch 7, so that the user can manually set the first predetermined temperature of the heating element 13, in the embodiment, the first predetermined temperature is 200° C. In other embodiments, the first predetermined temperature may be from 80° C. to 300° C.

S22, the airflow sensor 5 continues detecting the airflow signal, proceeds to step S23; the airflow sensor 5 does not detect the airflow signal again, proceeds to step S24;

S23. the controller 6 controls the heating element 13 to be heated to a second predetermined temperature, the temperature sensor 3 measures the temperature of the first chamber 11 and transmits the temperature signal to the controller 6, the controller 6 controls the heating element 13 to continue heating when detected temperature is lower than the second predetermined temperature, and the controller 6 controls the heating element 13 stops heating when the temperature is higher than the second predetermined temperature;

When the airflow sensor 5 continues to detect the airflow signal, indicating that the user is continuing to smoke, the controller 6 controls the heating element 13 to continue heating, so that the temperature in the first chamber 11 is maintained at a second predetermined temperature which is higher to further enhance user mouthfeel when the user is smoking, the second predetermined temperature generally ranges from 20° C. to 30° C. higher than the first predetermined temperature, in the present embodiment, the second predetermined temperature is 230° C.

S24. the temperature sensor 3 measures the temperature of the first chamber 11 and transmits the temperature signal to the controller 6, the controller 6 controls the heating element 13 to continue heating when the detected temperature is lower than the first predetermined temperature, and the controller 6 controls the heating element 13 to stop heating when the temperature is higher than the first predetermined temperature.

When the airflow sensor 5 does not detect the airflow signal, at this time the user suspends smoking, in order to save electric power of the tobacco evaporator, the controller 6 controls the heating element 13 to heat to maintain the temperature in the first chamber 11 at the first predetermined temperature.

The step S22 is repeated in a loop, and the operation of the heating element 13 can be controlled according to a smoking action of the user in real time, so as to adjust the temperature in the first chamber 11 in real time, which can improve smoking taste when the user smokes, and the heating temperature of the heating element 13 can be lowered to save energy when the user suspends the smoking action.

Specifically, the controller 6 has a storage function for storing a predetermined temperature, and the controller 6 further has a determining process. When the detected temperature is lower than the predetermined temperature, the controller 6 controls the heating element 13 to continue heating. When the temperature is higher than the predetermined temperature, the controller 6 controls the heating element 13 to stop heating. The controller 6 can also have a timing function to start timing when the heating element 13 reaches the predetermined temperature for the first time. When the user smokes for more than a predetermined period of time, the controller 6 controls the heating element 13 to stop heating, and a preset time adjustment button may also be defined at the switch 7, the user can set the smoking time by the button to protect the lifespan of the tobacco evaporator and to prevent the user from smoking too long.

Above all, the tobacco evaporator of the present application disperses heat generated by a heat generating component by providing mesh filter layer structures, so that the substance to be evaporated which is placed on the mesh filter layer structures is uniformly heated, so that scorching will not occur. By providing an heat insulating support, a heat insulating layer on the first chamber, and providing a heat insulating structure, a heat insulating layer or the like outside the second chamber, when the heating element generates heat, heat dissipation of the tobacco evaporator is slowed down, so as to shorten the preheating time of a heating wire and save battery power. The present application effectively solves the technical problem that the tobacco evaporator in the prior art cannot ensure short preheating time and small energy consumption, and cannot achieve softly baking taste and uniform baking smoke.

While the present application has been described typical embodiments of the present application, those skilled in the art can make additional changes and modifications to the embodiments as long as they know the creative conception of the present application. Therefore, the appended claims are intended to be interpreted as comprising the typical embodiments and other additions and modifications within a range of the present application.

It will be apparent that those skilled in the art can make various modifications and variations to the present application without departing from the spirit and scope of the present application. Thus, it is intended that the present application comprises such modifications and variations as the modifications and variations are within the scope of the appended claims and technical solutions which is equaled or similar to the appended claims.

The invention claimed is:

1. A tobacco evaporator wherein comprising a first chamber (11) configured to accommodate a substance to be evaporated, and a second chamber (12) configured to define a heating element (13), the first chamber (11) and the second chamber (12) are communicated with each other to form a first airflow passage; wherein at least two spaced layers of mesh filter layer structures (14) are defined in one end of the first chamber (11) adjacent to the second chamber (12), the filter layer structures (14) comprising a first filter layer (141), and a second filter layer (142) which is defined between the first filter layer (141) and the second chamber (12), the first filter layer (141) is distributed with a plurality of first filter holes (1411), the second filter layer (142) is provided with a plurality of second filter holes (1421); wherein the heating element (13) extends along an axial direction of the second chamber (12) in a spiral shape and abuts against a chamber wall of the second chamber (12) to transfer heat to the substance to be evaporated through the first airflow passage when the heating element (13) generates heat, so as to uniformly heat the substance to be evaporated; and wherein the second chamber (12) is provided with a heat insulation sleeve (15) to thermally insulate the second chamber (12) when the heating element (13) generates heat;

the tobacco evaporator further comprises a housing (1) comprising a receiving space, a barrel body (16) extending axially along the housing (1) is detachably defined inside the receiving space; the barrel body (16) comprises a first barrel body (161) and a second barrel body (162) which is formed by radially shrinking along the first barrel body (161), and the first chamber (11) is formed in the first barrel body (161), the second chamber (12) is formed in the second barrel body (162); a hollow bracket (18) is defined inside the housing (1); a first space (111) for heat insulating is defined between the first barrel body (161) and the bracket (18), the first space (111) is filled with a thermal insulation material; wherein a second space (121) for insulating is defined between the heat insulation sleeve (15) and the second barrel body (162); and wherein a third spacing space (10) is further defined between the housing (1) and the bracket (18).

2. The tobacco evaporator according to claim 1, wherein the tobacco evaporator further comprises a suction nozzle (2) connected to the housing (1), the suction nozzle (2) has a smoke outlet; and wherein one end of the heat insulation sleeve (15) abuts against an end wall of the first barrel body (161) opposite to the suction nozzle (2), and the other end of the heat insulation sleeve (15) is connected and provided with a supporting assembly (17), the supporting assembly (17) is configured to fixedly define the barrel body (16) inside the housing (1).

3. The tobacco evaporator according to claim 2, wherein a bottom portion of the second barrel body (162) is provided with a through hole (1621), and a holding member (1622) is sleeved inside the through hole (1621), one end of the holding member (1622) near the suction nozzle (2) is abutted against a bottom wall of the second barrel body (162), and the holding member (1622) is hollow and provided with a second air inlet hole (1623); and wherein an end wall of the first barrel body (161) opposite to the suction nozzle (2) is further provided with a first connecting hole (1613).

4. The tobacco evaporator according to claim 3, wherein the barrel body (16), the heat insulation sleeve (15) and the supporting assembly (17) are all accommodated inside the bracket (18); wherein one end of the bracket (18) near the suction nozzle (2) is provided with a bending portion (181), the bending portion (181) comprises a limiting portion (1811), and the limiting portion (1811) is elastically abutted against an end wall of the barrel body (16) near the suction nozzle (2), so as to define a space distance between an outer wall of the barrel body (16) and an inner wall of the bracket (18); wherein an outer wall of one end of the bracket (18) near the suction nozzle (2) is further provided with a convex portion (182), the convex portion (182) is configured to define a space distance between an outer wall of the bracket (18) and an inter wall of the housing (1); and wherein a sealing cover (19) is defined at one end of the bracket (18) opposite to the suction nozzle (2), and the bracket (18) is partially sleeved and fitted on an outer periphery of the sealing cover (19) and is detachably connected to the sealing cover (19).

5. The tobacco evaporator according to claim 4, wherein the supporting assembly (17) comprises a hollow pipe (171) defined opposite to the suction nozzle (2) and a support sleeve (172) defined adjacent to the suction nozzle (2), the heat insulation sleeve (15) is partially sleeved and fitted on an outer circumference of the support sleeve (172), and the support sleeve (172) is provided with two second connection holes (1721) which are opposite to each other; wherein the sealing cover (19) is provided with a first air inlet hole (191), and an end of the hollow pipe (171) opposite to the suction nozzle (2) abuts against the sealing cover (19); the first air inlet hole (191), the hollow pipe (171) and the second air inlet hole (1623) are sequentially in communications and communicate with the first air passage for directing smoke to the smoke outlet; and wherein an air guiding passage (100) is defined at one end of the housing (1) opposite to the suction nozzle (2), and the air guiding passage (100) is communicated with the first air inlet hole (191) through a hollow intake pipe (101), and an airflow sensing hole (102) are defined in a side wall of the air guiding passage (100).

6. The tobacco evaporator according to claim 5, wherein the tobacco evaporator further comprises: a temperature sensor (3) defined on an outer wall of the first barrel body (16) to measure a temperature of the first chamber (11) and transmit a temperature signal; a PCB circuit board (4) defined in the third spacing space (10); an airflow sensor (5) defined in a groove provided in an outer wall of the air guiding passage (100), and communicated with the air guiding passage (100) through the airflow sensing hole (102) to sense and transmit an airflow signal; a controller (6) defined on the circuit board (4) and connected to the heating element (13), the temperature sensor (3) and the airflow sensor (5), respectively, to receive the airflow signal and the temperature signal, and control the heating element (13) to heat the substance to be evaporated according to a predetermined temperature; a battery (7) defined in the third spacing space (10) to supply power to the airflow sensor (5), the temperature sensor (3), the controller (6) and the heating element (13); and a switch (8) defined on an outer wall of the housing (1) and respectively connected to the controller (6) and the battery (7) to control a connection of the controller (6) and the battery (7).

7. The tobacco evaporator according to claim 6, wherein one end of the heating element (13) passes through the holding member (1622) and goes through one of the second connecting holes (1721) to extend toward the sealing cover (19) and pass through the sealing cover (19) to connect to the controller (6) around one side of the battery (7), the other end of the heating element (13) passes through the first connecting hole (1613) and goes through the other one of the second connecting holes (1721) to pass through the sealing cover (19) to connect to the controller (6) around another side of the battery (7), two ends of the heating element (13) are separately and respectively soldered on opposite sides of the PCB circuit board (4).

8. The tobacco evaporator according to claim 2, wherein an inner wall of one end of the first barrel body (161) opposite to the suction nozzle (2) radially shrinks inward to form a first limiting step (1611) and a second limiting step (1612), the first limiting step (1611) and the second limiting step (1612) are respectively configured to clamp and position the first filter layer (141) and the second filter layer (142), so as to provide a flow gap between the first filter layer (141) and the second filter layer (142) to flow hot air, the flow gap between the first filter layer (141) and the second filter layer (142) ranges from 0.5 mm to 8 mm.

9. The tobacco evaporator according to claim 8, wherein a diameter of each of the first filter holes (1411) ranges from 0.2 to 3.0 mm, and the plurality of the first filter holes (1411) uniformly distributed in the first filter layer (141), a distance between centers of each two adjacent first filter holes (1411) ranges from 0.6 mm to 3.0 mm; and wherein a diameter of each of the second filter holes (1421) ranges from 0.8 to 6 mm, and a distance from a center of each of the second filter holes (1421) to a center of the second filter layer (142) ranges from 2 mm to 12 mm.

10. The tobacco evaporator according to claim 9, wherein a mesh smoke filtering layer (9) is further defined between the first chamber (11) and the suction nozzle (2), and the smoke filtering layer (9) is configured to filter smoke flowing from the first chamber (11) to the suction nozzle (2) and to prevent the substance to be evaporated from coming off the first chamber (11).

11. The tobacco evaporator according to claim 4, wherein the barrel body (16) is made of a metal material or a ceramic material, the heat insulation sleeve (15), the supporting assembly (17), the bracket (18) and the sealing cover (19) are all made of a thermal insulation material.

* * * * *